United States Patent [19]

Ballin

[11] 3,955,790

[45] May 11, 1976

[54] WALL HANGER DEVICE

[75] Inventor: Gene Ballin, Locust Valley, N.Y.

[73] Assignee: Betty Ballin, Merrick, N.Y.

[22] Filed: Sept. 12, 1974

[21] Appl. No.: 505,329

[52] U.S. Cl. ..... 248/489; 33/354; 33/391

[51] Int. Cl.[2] ..... A47G 1/16

[58] Field of Search ..... 248/496, 489, 477, 497, 248/495; 312/245; 211/88; 33/391, 354

[56] References Cited

UNITED STATES PATENTS

| | | | |
|---|---|---|---|
| 898,853 | 9/1908 | Durst | 33/391 X |
| 2,527,982 | 10/1950 | Brock | 33/391 |
| 2,635,840 | 4/1953 | Barry | 248/497 |
| 2,757,890 | 8/1956 | Sutton et al. | 248/496 X |
| 3,350,045 | 10/1967 | Mayers | 248/467 X |

*Primary Examiner*—J. Franklin Foss
*Attorney, Agent, or Firm*—Howard C. Miskin

[57] ABSTRACT

A wall hanger device includes a wall mountable first member having a pair of laterally spaced forwardly projecting support arms terminating in upwardly directed fingers and a forwardly directed intermediate bearing arm. A plumb defining elongated plate has a longitudinal opening in its upper part provided at its top with a depending fulcrum which separably rests on the bearing arm. Vertical lines are medially formed on the plumb and mounting plate and are in vertical longitudinal alignment when the support arms are at the same level. A bracket is mounted on a picture frame and includes a pair of laterally spaced, apertured arms for engaging the support arm fingers.

12 Claims, 12 Drawing Figures

WALL HANGER DEVICE

BACKGROUND OF THE INVENTION

The present invention relates generally to improvements in mounting devices and it relates more particularly to an improved picture hanger device.

A highly inconvenient, awkward and frequently difficult and time consuming chore is the proper hanging of a picture on a wall. To properly hang the picture, many conditions must be satisfied. Not only should the picture be centered and at the proper level, but it should be accurately levelled. Any significant deviation from the accurate orientation and positioning of the picture is very obvious and hence highly unattractive. Numerous picture hanger devices and arrangements have been available and proposed, but these possess numerous drawbacks and disadvantages. Occasionally, when the difference in spacing of the wall bracket and the cooperating member on the picture is underestimated, the wall hanger is visible, necessitating redoing the clamping operation. These have been difficult and inconvenient to use and they are frequently ineffective in permitting the proper independent accomplishment of the positioning and orienting of the picture, and they are of little versatility and adaptability and otherwise leave much to be desired.

SUMMARY OF THE INVENTION

It is a principal object of the present invention to provide an improved mounting device.

Another object of the present invention is to provide an improved picture hanging device.

Still another object of the present invention is to provide an improved device which permits the accurate hanging of a picture in a desired preselected portion and in a level condition without the necessity of adjusting the picture during or following the hanging thereof.

A further object of the present invention is to provide a device of the above nature characterized in its simplicity, ruggedness, reliability, ease and convenience of use and great versatility and adaptability.

The above and other objects of the present invention will become apparent from a reading of the following description taken in conjunction with the accompanying drawings which illustrate preferred embodiments thereof.

In a sense the present invention contemplates the provision of an improved hanger device which comprises a mounting plate, a pair of laterally spaced support elements mounted on and positioned forwardly of the mounting plate and levelling means located on the mounting plate for indicating the relationship of the support elements to the horizontal. In the preferred form of the improved hanging device the mounting plate is backed by a thin compressible pad and the support elements are integrally formed with the mounting plate and include a pair of laterally spaced forwardly extending arms joining inwardly projecting legs which terminate in upwardly directed fingers. The levelling means include a bearing arm projecting from the mounting plate and located intermediate the support elements and a plumb member in the form of an elongated strip having a longitudinal slot in its upper part and a fulcrum medially depending from the upper edge of the slot. A vertical line perpendicular to a line joining corresponding points on the support elements is located on the amounting plate in medial alignment with the bearing arm and a medial longitudinal line is located on the plumb member and extends downwardly from the slot lower edge. When the plumb member is swingably supported by the bearing arm and fulcrum and the support elements are at a common level the lines are colinear. A coupling member is associated with the hanger device and is attached to the picture frame and includes a mounting plate provided with a pair of rearwardly projecting laterally spaced arms with openings, whose separation is equal to that of the support elements and are adapted to engage the support element fingers.

The improved hanger device is simple, rugged and reliable and is easy and convenient to use and permits the accurate and level hanging of a picture without the necessity of adjusting the picture during or following the hanging thereof.

DESCRIPTION OF THE PREFERRED EMBODIMENTS

Figure 1:
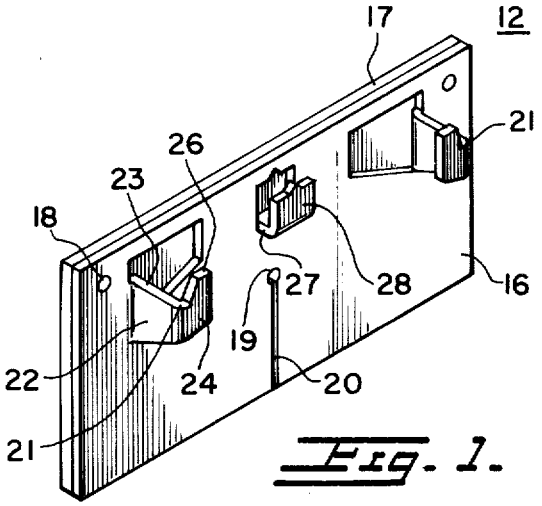
FIG. 1 is a front perspective view of the wall mounting section of a picture hanging device embodying the present invention.
Figure 2:
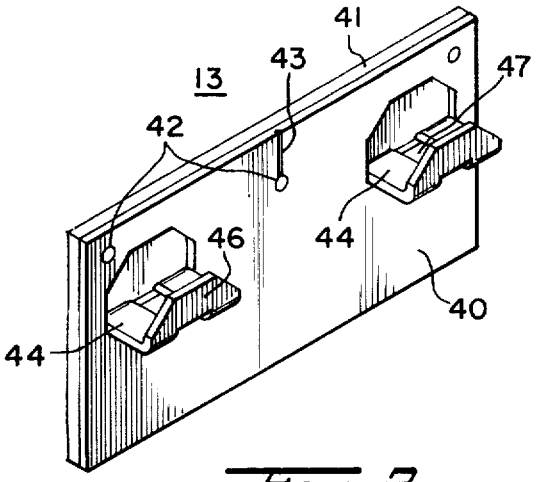
FIG. 2 is a rear perspective view of a coupling device which is employed with hanging device of FIG. 1.

Referring now to the drawings, particularly FIGS. 1–7 thereof which illustrate a preferred embodiment of the present invention as applied to the wall hanging of a picture, the reference numeral 10 generally designates the top horizontal leg of a picture frame and 11 the wall upon which the picture is to be hung. The components for accurately hanging the picture at the desired position in a level condition includes a hanger device or wall mounting member 12, a picture mounted coupling member 13 and a level indicating device or plumb member 14.

The hanger member 12 is advantageously integrally formed as a unit from sheet metal and includes a flat rectangular mounting plate 16 whose long axis is horizontal, the plate 16 advantageously being backed by a coextensive cushion pad defining sheet 17 of compressible resilient material such as foamed soft polymeric resin. A pair of symmetrically positioned fasteners receiving openings 18 are formed in opposite upper corners of plate 16 and another fastener receiving opening 19 is centrally formed in plate 16. Extending downwardly from opening 19 and coinciding with the medial vertical axis of plate 16 is a first index line 20 which is impressed in the front face of plate 16 and reaches the lower edge thereof.

A pair of symmetrically positioned and symmetrically related similar support elements 21 are located on the upper part of plate 16 shortly inwardly of openings 18. Each of the support elements 21 includes a forwardly directed arm 22 having a horizontal top edge 23 and a forwardly upwardly inclined bottom edge. Projecting inwardly from the front end of each arm 22 is an inwardly directed arm 24 which terminates in an upwardly directed finger 26 having an upwardly inwardly inclined outer edge and a vertical inner edge.

Projecting forwardly from the upper part of plate 16 intermediate the support elements 21 and symmetrical to the vertical medial axis of plate 16 is a horizontal bearing arm which terminates in an upwardly directed leg 28 provided along its top edge with a medially located triangular vertical projection.

The level indicator or plumb member 14 consists of an elongated metal plate or strip 29 having formed in the upper half thereof a longitudinal medially longitudinally extending wide slot divided by a horizontal cross piece into upper and lower rectangular openings 32 and 33 respectively, a pair of rearwardly projecting dimples 34 being formed in the side borders of strip 29 at the level of cross piece 30. The upper border of upper opening 32 has similar side edges 36, which converge downwardly to a medially positioned downwardly directed fulcrum 37. The width of upper opening 32 is slightly greater than that of bearing arm 27 to permit the free swinging of plumb member 14 when fulcrum 37 rests on bearing arm 27, while restricting any significant lateral play of the plumb member thereon and the height of upper opening 32 is sufficient to permit the passage of leg 28, so that plumb member 14 may be positioned on, and separated from, bearing arm 27. The lower opening 33 extends vertically to a point shortly above the bottom edge of plate 16, when plumb member 14 is supported by bearing arm 27, so as to expose a first index line 20. A second index line 38 is longitudinally vertically formed in the front face of strip 29 and extends to the bottom edge of bottom opening 33.

Figure 3:
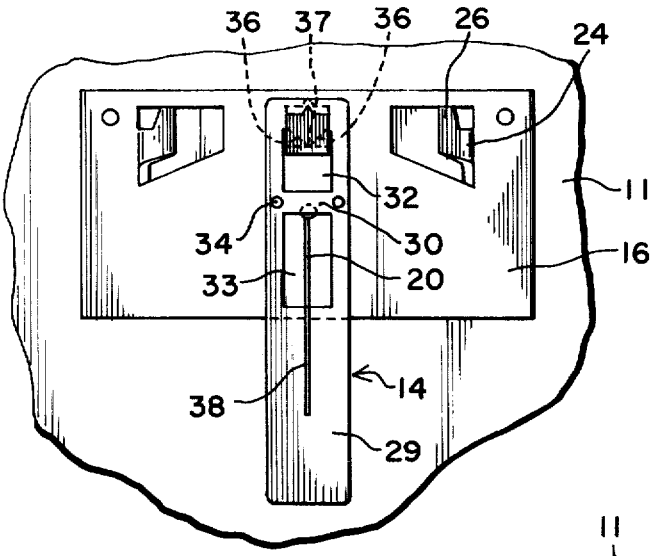
FIG. 3 is a front elevational view of the hanging device and the associated level indicator illustrated mounted in a wall.
Figure 4:
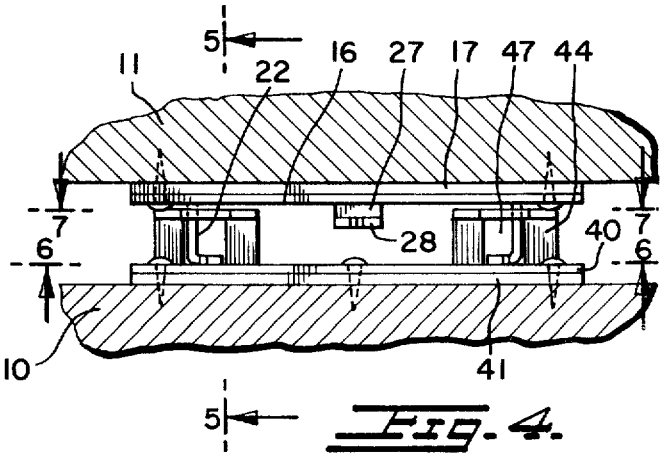
FIG. 4 is a top plan view of the mounted hanging device and the supported coupling member.
Figure 6:
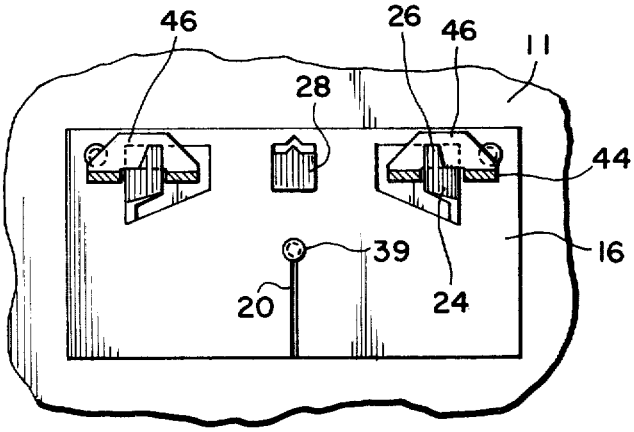
FIG. 6 is a sectional view taken along line 6—6 in FIG. 4.
Figure 7:
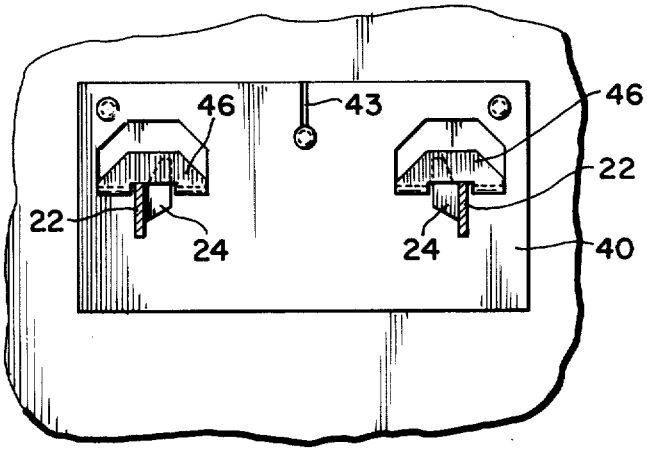
FIG. 7 is a sectional view taken along line 7—7 in FIG. 4—4.
Figure 5:
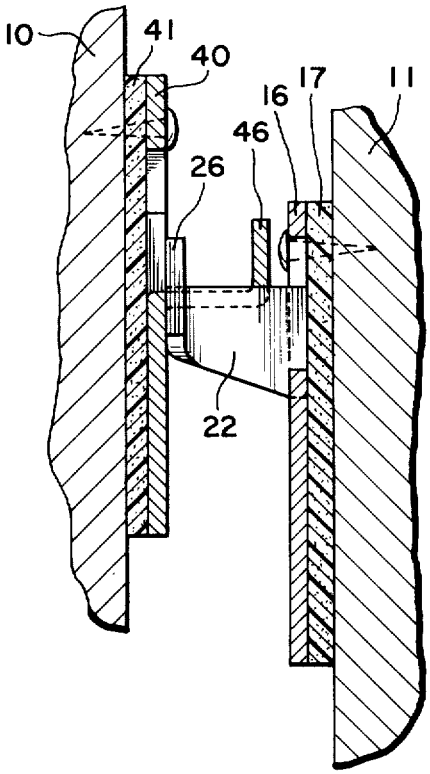
FIG. 5 is a sectional view taken along line 5—5 in FIG. 4.

In mounting the hanger device 12 on wall 11, with the plumb member 14 separated, the device 12 is secured to the wall 11 at the desired position and levelled for angular adjustment by means of a nail 39 driven through opening 19 into wall 11. The plumb member 14 is then applied to the hanger 12 with fulcrum 37 resting on bearing arm 27 to be freely swingable. The mounting plate 16 is then angularly adjustable about nail 39 until index lines 20 and 38 are in colinear registry as shown in FIG. 3, at which position the support elements 21 are level, that is in the same horizontal plane. Nails are then driven into wall 11 through openings 18 to complete the wall mounting of hanger 12.

The coupling member 13 includes a rectangular plate 40 backed by an attached cushion pad 41 similar to pad 17 and having medial and side nail receiving openings 42 in the upper border thereof, a vertical positioning line 43 extending upwardly from medial opening 42. Integrally formed with and projecting forwardly from the upper part of plate 40 below openings 42 is a pair of laterally spaced forwardly projecting arms 44 terminating in upwardly directed cross piece defining short legs 46. Longitudinally extending slots 47 are formed in and for the full lengths of arms 44 and are symmetrically positioned relative to the vertical medial axis of plate 40 and are of greater width than that of the bases of support elements fingers 26 and spaced to receive the fingers 26.

The coupling member plate 40 is medially secured to the rear face of picture frame leg 10 below the upper edge thereof by means of nails extending through openings 42. In attaching the picture to the wall mounted hanger 12, the picture is brought to the wall with slots 47 in vertical alignment with fingers 26 and the picture is then lowered until fingers 26 engage slots 47 and cross pieces 46 rest on arms 22 in which position the picture is in a level condition.

It should be noted that the hanger arrangement described above may be employed for hanging articles other than pictures. Moreover, the outer faces of one or both pads 17 and 41 may be provided with a layer of a pressure sensitive adhesive to facilitate the attachment of members 12 and 13 and avoid the use of nails. With such use, the plumb member 14 is applied to hanger 12 prior to hanger 12 being pressed against the wall. The hanger 12 with plumb 14 mounted about fulcrum 37 is juxtapositioned to the wall where it is to be mounted and then pivoted until the index lines are in registry as before mentioned, and the hanger pressed against the wall, securely positioning it for receiving the coupling member plate 40 on the picture.

Figure 8:
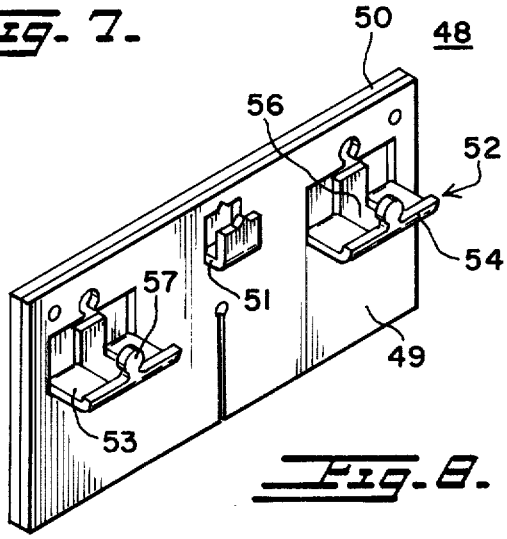
FIG. 8 is a front perspective view of the wall mounting section of another embodiment of the present invention.
Figure 9:
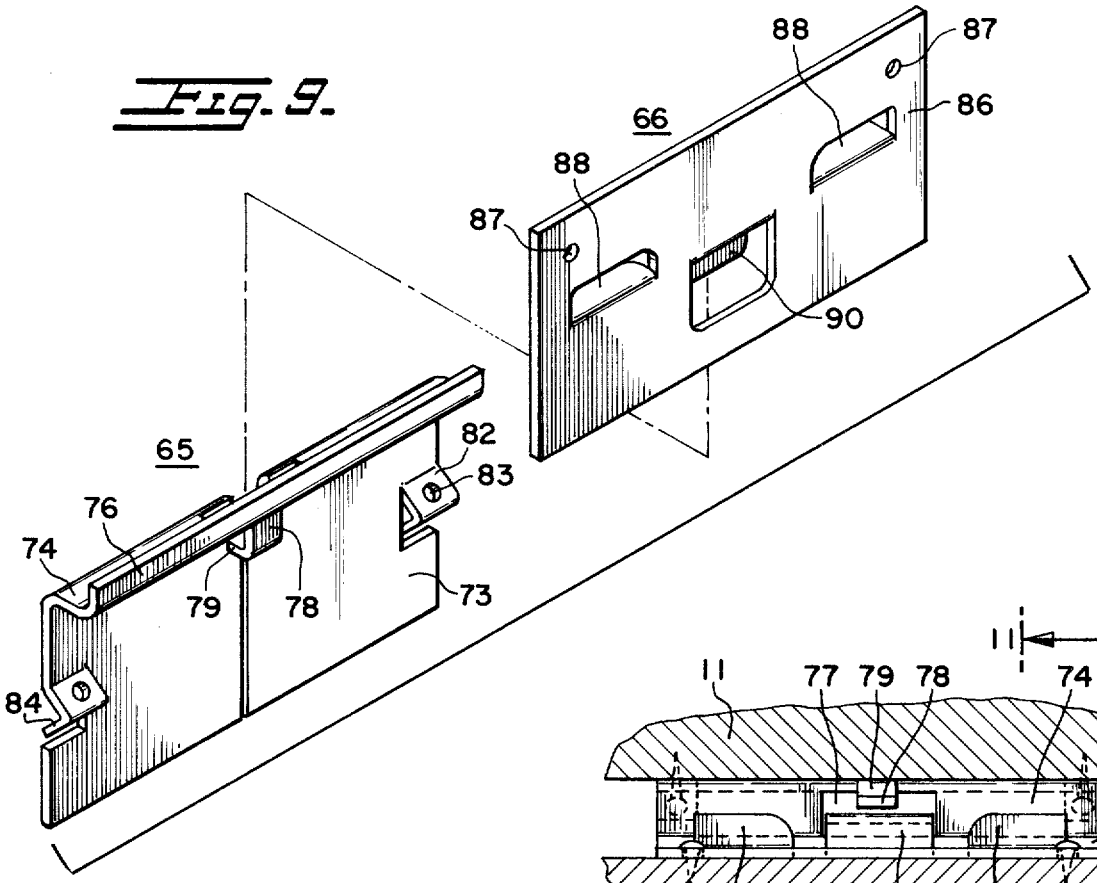
FIG. 9 is a front perspective view of another embodiment of the present invention shown in a separated condition and in the absence of the plumb member.
Figure 10:
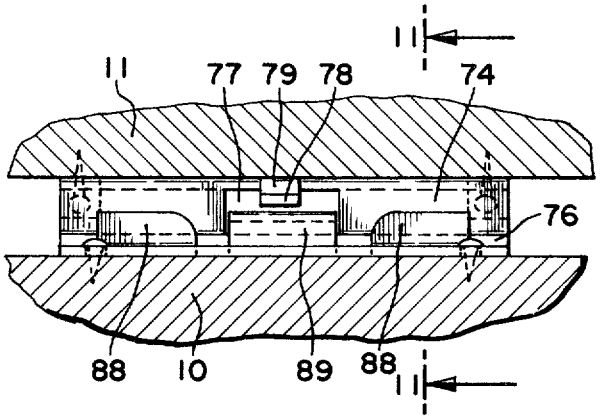
FIG. 10 is a top plan view thereof in a coupled condition and secured to a wall and a picture frame.
Figure 11:
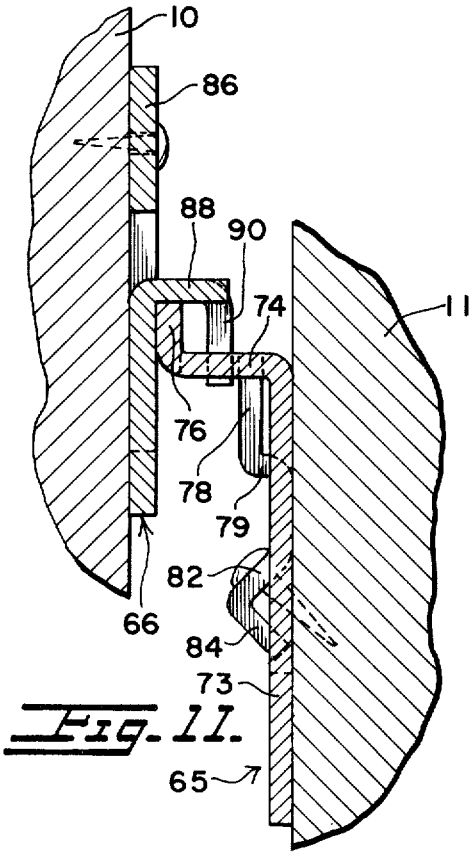
FIG. 11 is an enlarged sectional view taken along line 11—11 in FIG. 10.
Figure 12:
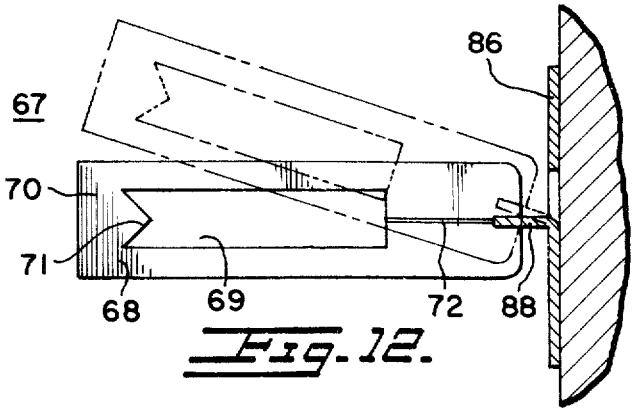
FIG. 12 is a vertical sectional view of the picture mounted coupling member and the plumb member shown in the act of adjusting the coupling member.

In FIG. 8 of the drawings there is illustrated another embodiment of the present invention which differs from that first described only in the structure of the support elements permitting the use of similar members for the wall mounting hanger and the picture mounted coupling member and in all other respects is similar to hanger member 12. Specifically, the hanger coupling member 48 includes a rectangular mounting plate 49 backed by a cushioning pad 50 and provided with fastener receiving openings corresponding to openings 18 and 19, on index line corresponding to index line 20 and bearing arm 51 corresponding to bearing arm 27. A separable plumb member corresponding to plumb member 14 is provided for use with hanger member 48.

In place of the support elements 21 there are provided a pair of symmetrically positioned support elements 52. Each of the support elements 52 includes a wide forwardly directed horizontal arm 52 terminating in an upwardly directed lip 54 and having a wide medial slot 56 extending longitudinally for the full length of arm 53. Directed vertically upwardly from the midpoint of lip 54 is a circular finger 57 of a width slightly less than that of slot 56.

The use and application of the hanger and coupling member are similar to those of hanger and coupling member 12 and 13 described above.

The use of the same construction for a wall hanger as for the picture mounted coupling member reduces the inventory requirements and makes easier packaging and production procedures.

Referring now to FIGS. 9–12 which illustrate another embodiment of the present invention which includes a wall mounting hanger member 65, a picture frame mounted coupling member 66 and a plumb member 67. The plumb member 67 comprises an elongated rectangular metal strip 68 having a wide medial longitudinal slot 69 delineated at its upper end by a cross arm 60 having a fulcrum defining inwardly directed section 71. Extending from the opposite end of the slot 69 in a medial longitudinal index line 72 which joins a short narrow medial slot at the lower end of plumb member 67 whose function will be hereinafter explained.

The hanger member 65 includes a rectangular metal plate 73 provided along its top edge with an integrally formed rearwardly directed flange 74 terminating in an upwardly directed lip 76. A rectangular opening 77 is formed in flange 74 intermediate its ends and for the full depth thereof and formed from the upper border of plate 73 is a medially located upwardly directed finger 78 joined at its bottom to plate 73 by a rearwardly extending arm 79. The upper end of finger 78 centrally registers with opening 77 and is at about the level of flange 74. Formed in the rear face of plate 73 is a medial vertical index line 80 which extends from arm 79 to the bottom edge of plate 73. Formed from and located along each side border of plate 73 intermediate the top and bottom thereof is a wall mounting lug 81 including a rearwardly downwardly inclined upper arm 82 having a nail receiving opening 83, the arm 82 at its upper edge joining plate 73 and at its lower edge joining a forwardly downwardly inclined arm 84.

The coupling member 66 includes a rectangular metal plate 86 provided at its upper corners with nail receiving holes 87. A pair of substantially coplanar symmetrically spaced laterally spaced laterally extending forwardly directed ears 88 are formed from plate 86 intermediate the top and bottom thereof. Also formed from the plate 86 is a medally positioned forwardly projecting horizontal arm 89 coplanar with ears 88 and terminating in a vertically depending finger 90 located forwardly of plate 86.

In mounting the hanger member 65 to the wall 11, the procedure used in connection with the first described embodiment is followed, the plumb member 67 being hooked over and swingably suspended from arm 79 with the fulcrum 71 resting on the arm 79 so that the levelling of the hanger member 65 is achieved when the index lines 72 and 80 are in alignment. The coupling member 66 is medially received to the upper leg 10 of the picture frame by nails as earlier described, and the coupling member 66 attached to the picture frame, following the separation of the plumb member 67 is coupled to the hanger member 65 by laterally sliding it along hanger member 65 with the finger 90 engaging the top face of flange 74 until the finger 90 registers with opening 77. The coupling member 66 and the picture are then dropped until the ears 88 rest on the lip 76. In the event that the picture does not assume a level altitude it may be removed from the hanger member 65 with the uncoupling of coupling member 66 and the appropriate ear 88 bent in a suitable direction. To facilitate the bending of the ear, the plumb member 67 may be employed by engaging the ear with the slot at the end of the plumb member and using the plumb member as a lever. The picture is then coupled to the hanger member in the manner described above.

The various members could be made from metal or a rigid plastic material.

While there have been described and illustrated preferred embodiments of the present advantage, it is apparent that numerous alterations, omissions and additions may be made without departing from the spirit thereof.

What is claimed is:

1. A hanger device comprising a mounting plate, laterally spaced support elements mounted on and positioned forwardly of said plate, and level indicating means located on said mounting plate for indicating the relationship of said support elements to the horizontal, said level indicating means comprising a plumb member suspended from said mounting plate, said mounting plate having indicia thereon registering with a predetermined section of said plumb member when said support elements are at a common level.

2. The hanger device of claim 1 wherein said plumb member is separably suspended from said mounting plate.

3. A hanger device comprising a mounting plate, laterally spaced support elements mounted on and positioned forwardly of said plate, and level indicating means located on said mounting plate for indicating the relationship of said support elements to the horizontal and including a bearing arm positioned and directed forwardly from said mounting plate and a plumb member including a fulcrum depending from the upper part thereof and resting on said bearing arm and being suspended from said mounting plate, said mounting plate having indicia thereon registering with a predetermined section of said plumb member when said support elements are at a common level.

4. The hanger device of claim 3 wherein said plumb member comprises an elongated plate having a medially located opening in the upper part thereof terminating at its top in a cross piece, said fulcrum being medially located on and depending from said cross piece.

5. The hanger device of claim 4 including indicia on said plumb member plate proximate the lower edge of said opening in longitudinal alignment with said fulcrum said mounting plate indicia being visually accessible through said plumb member plate opening and registering with said mounting plate indicia when said support elements are at a common level.

6. The hanger device of claim 5 wherein said mounting plate indicia comprises a straight line perpendicular to the line extending between corresponding points on said support elements and said plumb plate indicia comprises a longitudinal line.

7. The hanger device of claim 3 including a layer of cushioning material superimposed on the rear face of said mounting plate.

8. The hanger device of claim 3 wherein each of said mounting elements comprises a forwardly directed arm extending from said mounting plate and terminating at its free end in an inwardly offset upwardly directed finger.

9. The hanger device of claim 3 wherein each of said mounting elements comprises a forwardly directed arm extending from said mounting plate and having a longitudinal slot formed therein and terminating at its free end in an upwardly directed finger in longitudinal alignment with and of less width than said slot.

10. In combination with the hanger device of claim 8, a coupling member including a mounting plate for attachment to a picture frame and a pair of laterally spaced arms projecting from said coupling member mounting plate and having openings therein releasably engaging said fingers.

11. The hanger device of claim 3 including a rearwardly projecting laterally extending flange formed along the upper edge of said mounting plate and terminating in an upwardly directed lip and defining said laterally spaced support elements.

12. In combination with the hanger device of claim 11, a coupling member including a mounting plate for attachment to a picture frame and a pair of laterally spaced arms projecting from said coupling member mounting plate and resting on said lip.

* * * * *